United States Patent [19]

Smith et al.

[11] Patent Number: 4,842,652

[45] Date of Patent: Jun. 27, 1989

[54] METHOD FOR IMPROVING FRACTURE TOUGHNESS OF HIGH STRENGTH TITANIUM ALLOY

[75] Inventors: Michael P. Smith, Glastonbury; Edgar E. Brown, South Windsor; Martin J. Blackburn, Kensington, all of Conn.

[73] Assignee: United Technologies Corporation, Hartford, Conn.

[21] Appl. No.: 122,865

[22] Filed: Nov. 19, 1987

[51] Int. Cl.[4] ..... C22F 1/18

[52] U.S. Cl. ..... 148/12.7 B; 148/11.5 C; 148/20

[58] Field of Search ..... 148/12.7 B, 11.5 C, 148/20

[56] References Cited

U.S. PATENT DOCUMENTS

| | | | |
|---|---|---|---|
| 3,748,194 | 7/1973 | Ruckle et al. | 148/12.7 B |
| 3,901,743 | 8/1975 | Sprague et al. | 148/12.7 B |
| 3,969,155 | 7/1976 | McKeighen | 148/12.7 B |
| 4,053,330 | 10/1987 | Henricks et al. | 148/12.7 B |
| 4,543,132 | 9/1985 | Berczik et al. | 148/12.7 B |
| 4,581,077 | 4/1986 | Sakuyama et al. | 148/12.7 B |
| 4,631,092 | 12/1986 | Ruckle et al. | 148/12.7 B |

*Primary Examiner*—Upendra Roy

*Attorney, Agent, or Firm*—Charles E. Sohl

[57] ABSTRACT

Processing of Ti-6246 for improved mechanical properties including fracture toughness and low cycle fatigue. The process includes beta forging, sub beta transus solutionizing, controlled cooling and precipitation treating.

10 Claims, 4 Drawing Sheets

500 X

METHOD FOR IMPROVING FRACTURE TOUGHNESS OF HIGH STRENGTH TITANIUM ALLOY

TECHNICAL FIELD

This invention relates to the thermal mechanical processing of titanium-6Al-2Sn-4Zr-6Mo (Ti-6246) alloy articles for improved fracture toughness and low cycle fatigue properties.

BACKGROUND ART

Titanium alloys are widely used in the high performance applications, such as gas turbine engines. For every application there is different balance of properties required. However, in gas turbine engine applications there is a common requirement for a good low cycle fatigue properties combined with a high fracture toughness and good tensile properties. Low crack nucleation and growth rates under cyclic loads are particularly important factors in rotating applications such as gas turbine disks which must be resistant to fatigue and, in the event of damage must be resistant to crack propagation. Should a crack form, the limiting size before rapid failure is set by the fracture toughness of the material. The larger the value the more crack tolerant the material. For disks operating at higher temperatures (>500° F.), good creep properties are required along with freedom from property degradation during long time exposures.

The Ti-6Al-2Sn-4Zr-6Mo alloy is potentially attractive for gas turbine engine applications because of its good tensile and low cycle fatigue properties. Unfortunately, to date, this alloy as conventionally processed has displayed relatively low fracture toughness and shows a significant reduction in low cycle fatigue properties when the surface of the article is even slightly damaged, i.e. scratched. These drawbacks have limited usage of this alloy in gas turbine engines.

DISCLOSURE OF INVENTION

According to the present invention Ti-6246 alloy articles with improved properties are produced by isothermally forging the starting material in the beta phase field, solution treating the forged article in the two-phase (alpha plus beta) field, cooling at a controlled rate and precipitation treating at about 1100° F.

The foregoing, and other features and advantages of the present invention will become more apparent from the following description and accompany drawing.

BEST MODE FOR CARRYING OUT THE INVENTION

The invention comprises a thermal mechanical process for improving certain properties of Ti-6246 without unduly reducing other important properties. The commercial composition limits for Ti-6246 are shown in Table I.

TABLE I

| (Weight Percent) | |
|---|---|
| Al | 5.5–6.5 |
| Zr | 3.5–4.5 |
| Sn | 1.75–2.25 |
| Mo | 5.5–6.5 |
| Balance essentially titanium | |

This alloy can be processed to improve fracture toughness and to reduce low cycle fatigue sensitivity to surface defects as follows. The first step is to forge the material in the beta phase field. In this alloy the beta transus occurs at approximtely 1730° F. and the forging operation is therefore performed above this temperature, but preferably within about 100° F. of the beta transus. All portions of the alloy article must remain above the beta transus temperature during forging. This necessitates the use of dies heated to a temperature which will prevent cooling of the alloy surface below the beta transus during forging. The dies are preferably heated to a temperature above the beta transus and also preferrably heated to within about 50° F. of the desired forging temperature. In order to attain the desired results the forging operation should produce a reduction in area of at least about 50%, especially in critical part areas.

The forged article is then solution treated at a temperature below the beta transus, preferably between about 1630° F. and 1730° F., i.e. below but within about 100° F. of the beta transus. The solution treatment period will generally be from about 1 to about 4 hours.

A significant step in the process is the cooling step after the solution treatment. The cooling rate must be controlled to achieve the proper balance between strength and fracture toughness/ductility properties. The cooling rate is important from the solution treatment temperature down to about 700° F. where the alloy becomes thermally stable. The most critical portion of this range is that between the solution treatment temperature and about 1400° F.

Figure 1:
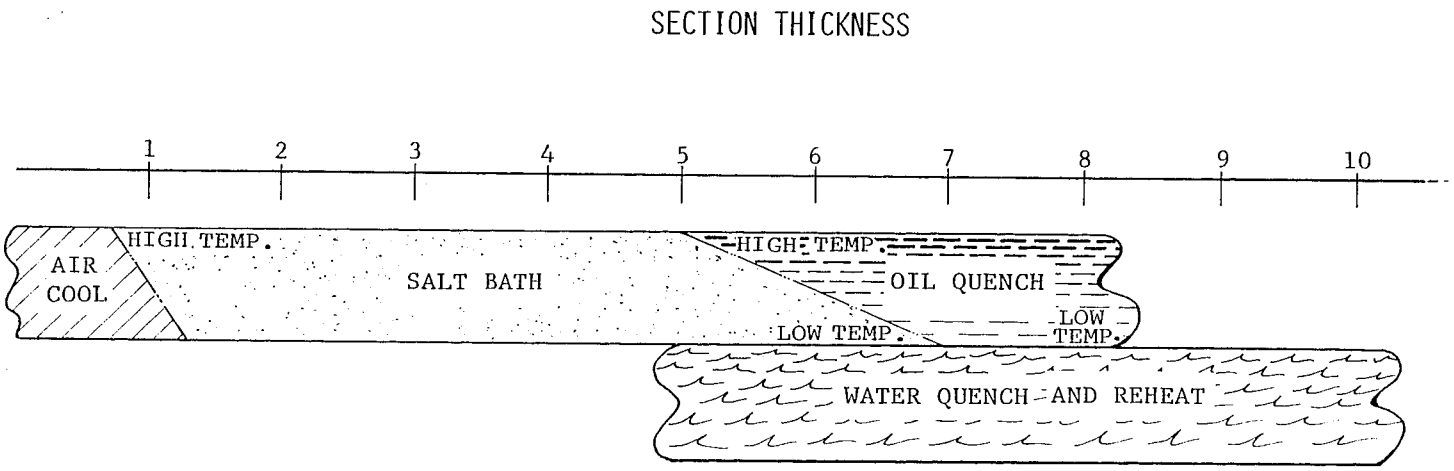
FIG. 1 shows the relationship between section thickness and cooling technique.
Figure 2:
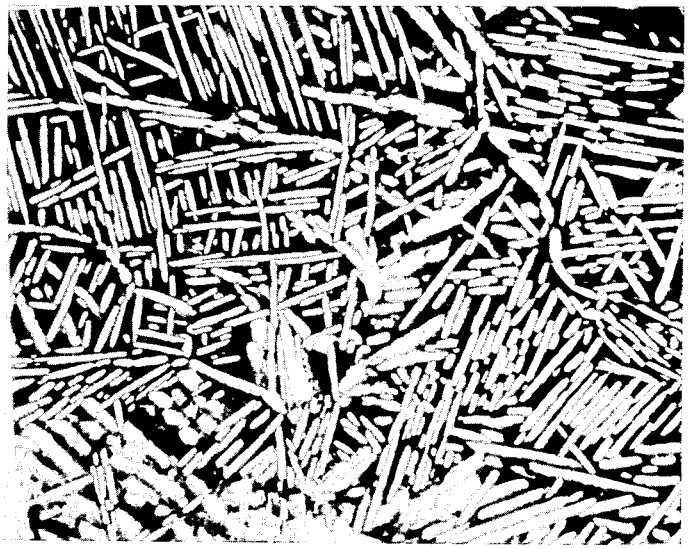
FIG. 2 is a photomicrograph of invention processed material.

Various methods are available to provide the necessary cooling rate depending upon article size, mass and geometry. Practical industrial cooling techniques range from air cooling, (a slow rate) to water quenching (a rapid rate). For a particular cooling technique, a thin section (low mass) article will cool more rapidly than a thick section (high mass) article. For a particular cooling technique, section thickness is the primary cooling rate determinant. Thus, to achieve a specific cooling rate within the range necessary for the invention the section size of the article must be coordinated with the cooling technique. FIG. 2 is a schematic illustrating th appropriate cooling techniques for different thickness sections.

Referring to FIG. 2, thin section articles, less than about one inch in thickness can be cooled at the necessary rate by air cooling.

Thicker sections up to approximately six inches can be cooled through the critical temperature range at an appropriate rate by transferring them directly from the solution treatment furnace to a salt bath. Relatively thin section parts, on the order of one to two inches will experience the desired cooling rate in a high temperature salt bath, on the order of 1000° F. to 1400° F. while relatively thick sections on the order of 4 to 6 inches will undergo the desired cooling rate in low temperature salt bath on the order of 350° F. to 600° F. For thicker sections, about 4 to 8 inches, oil quenching may be employed.

An alternative process for extremely thick section articles (greater than about 6 inches) is to give them a very aggressive quench, in water for example, and then reheat them in the temperature range of 1500° F. to 1600° F. for 1–4 hours. This is the most aggressive cooling technique and is applicable to the thickness section articles.

The cooling rate objective can be specified as an actual average metal cooling rate approximately equal to that experienced by a 0.25–1.0 inch section cooled in still air.

For articles of varying thickness the cooling technique is selected to give the invention cooling rate (and therefor the invention properties) in that portion of the article which requires the best properties.

Those skilled in the art will appreciate these variations, especially cooling media agitation, can be used to modify the cooling rate. Also, the cooling rate of a water bath can be modified by addition such as salt and soluble oils. These and other variations are all intended to fall within the scope of the invention.

After the cooling step, and regardless of the alternative employed, the article is given a precipitation treatment at a temperature of about 1100° F. (i.e. 1000° F.–1200° F.) for from about 2 to about 16 hours.

Forging above the beta transus transition results in an acicular "basket weave" alpha phase morphology upon subsequent cooling. It is well known that this morphology results in increased toughness in titanium alloys usually accompanied by debits in low cycle fatigue and tensile ductility. The disclosed heat treatment processes result in increased toughness without incurring a large low cycle fatique debit.

Solution treating of alpha + beta titanium alloys near but below the transformation temperature increases the amount of beta phase present while restricting grain growth which would occur rapidly above the beta transus. Increasing the amount of beta phase increases alloy strength. The key to achieving the desired property balance in the alloy is the post-solution processing, primarily the cooling method, in which amounts of metastable beta, martensite and alpha are obtained. Additionally, the morphology of the transformed alpha is also established during this treatment. For optimum toughness, a coarse network of alpha platelets in a Widmanstatten ("basket weave") or colony array is required as shown in FIG. 2. This is attained by controlling cooling rate, i.e. by air cooling, or in complex geometry articles, by isothermally transformation and growth in molten salt or in a conventional furnace in the 1500° F.–1650° F. range after a water quench. During this step decomposition of any remaining matensite is accomplished. Precipitation treating results in the formation of a network of very fine alpha platelets in the beta regions.

Table II shows tensile properties at different temperatures for thin section material processed according to the air cool embodiment of the present invention. The parenthetical values are values for conventionally processed Ti-6246 material. It can be seen that the invention tensile properties are only slightly lower than the conventionally processed properties.

Tables III and IV show tensile properties for Ti-6246 processed according to the salt quench and water quench plus reheat embodiments of the invention respectively with parenthetical values for conventionally processed material. It can be seen that the creep properties for the invention processed material are comparable to those of the prior art processed material. Tables II, III and IV also show typical values for room temperature fracture toughness of Ti-6246 processed according to the invention and again with parenthetical values for conventionally processed material. Here it can be seen that the room temperature fracture toughness values for the present invention are significantly greater than those resulting from prior art processing. Tables II and IV show substantially equivalent and markedly increased creep behavior respectively for the invention material.

Figure 3:
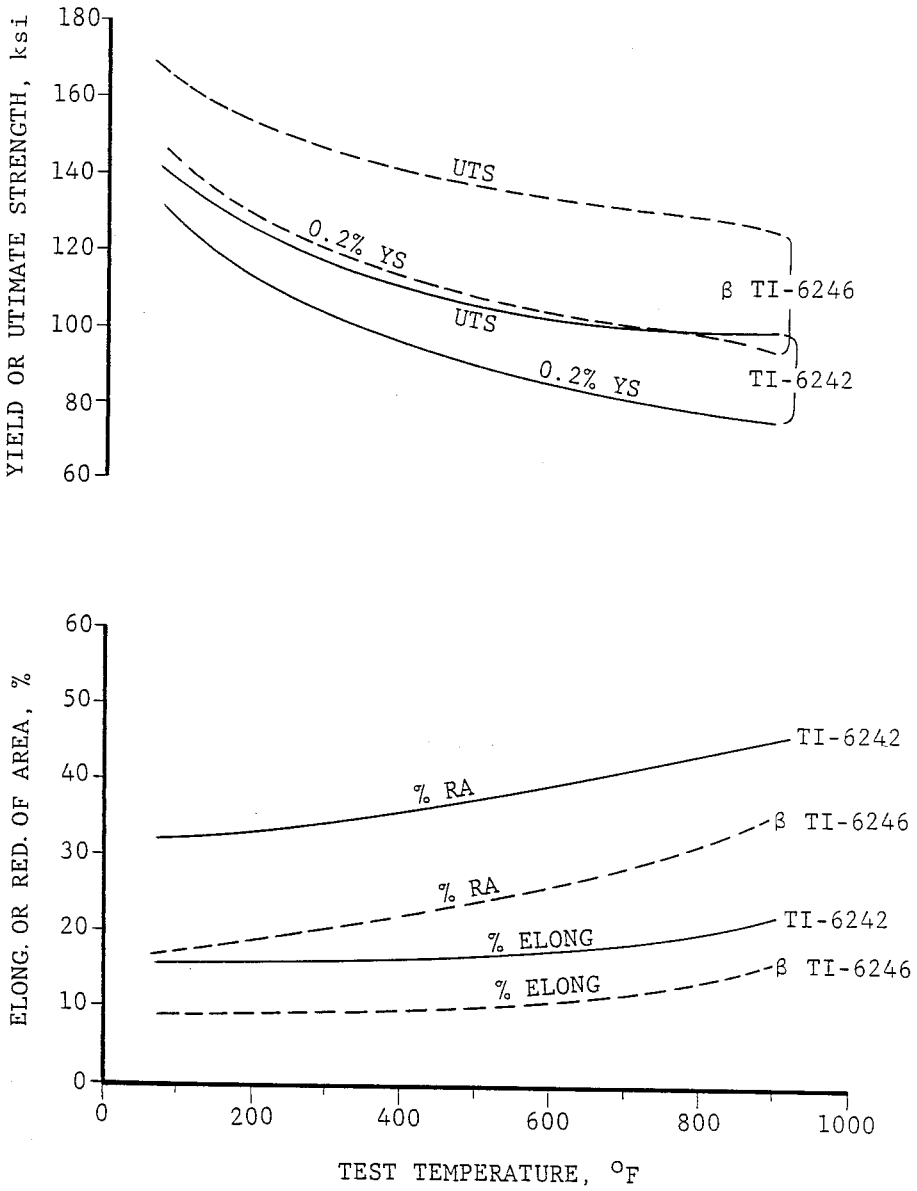
FIG. 3 shows tensile properties of invention processed material and prior art processed material.
Figure 4:
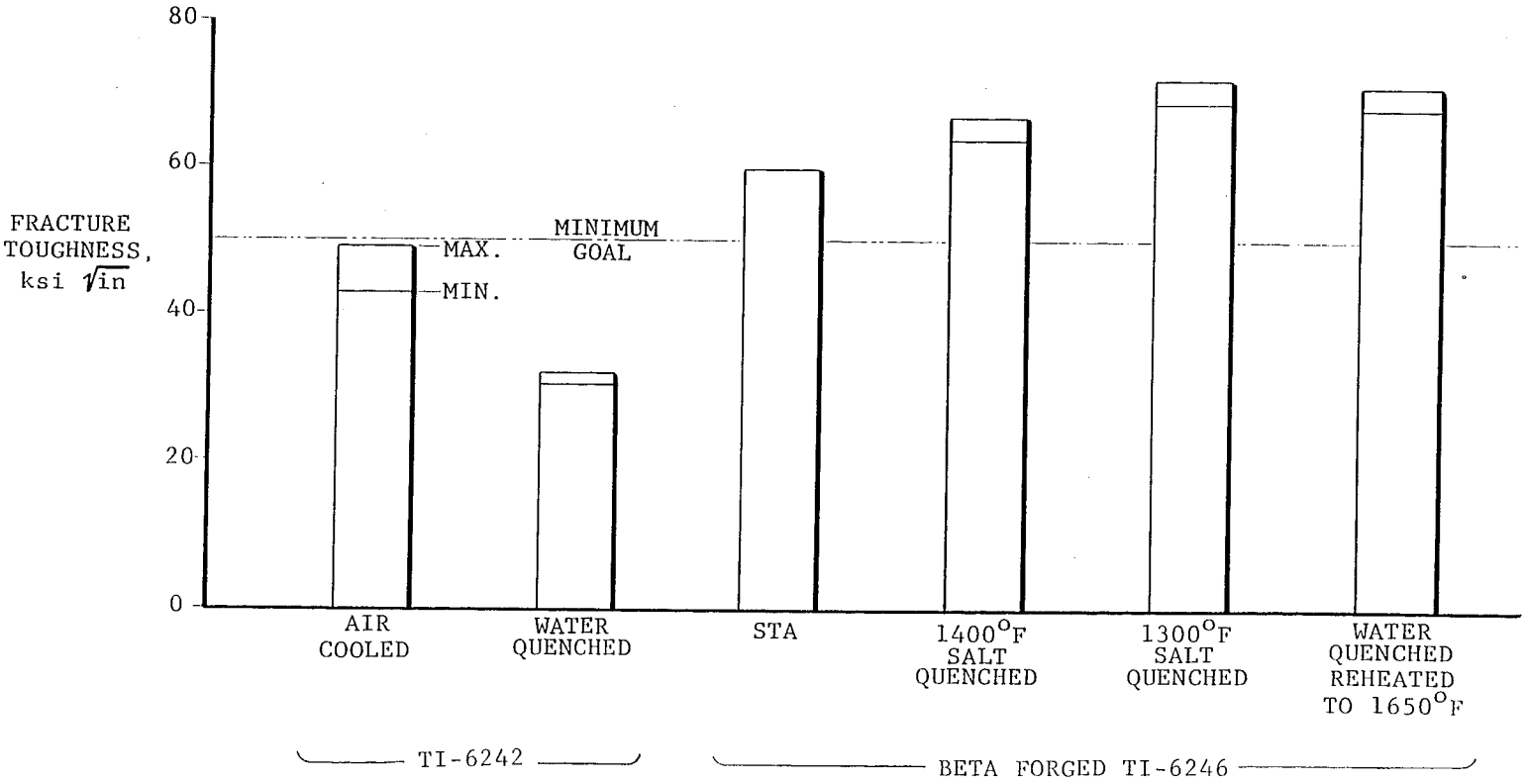
FIG. 4 shows fracture toughness values for inventions processed and prior art processed material.

Another widely used titanium alloy is Ti-6242 (Ti-6Al-2Sn-4Zr-2Mo). This alloy is currently more widely used than Ti-6246 in rotating gas turbine applications because it provides a better balance of fracture toughness and tensile properties than does prior art processed Ti-6246. FIG. 3 compares tensile properties, as a function of temperature, for Ti-6246 processed according to the invention and Ti-6242. It can be seen that, in terms of strength, that the present invention processed material is stronger than the Ti-6242 but has lesser elongation. FIG. 4 is a bar chart showing the fracture toughness of Ti-6246 processed according to the present invention and Ti-6242 given two different processes. It can be seen that the invention processed material has a higher fracture toughness value than the Ti-6242, and it can also be seen that the salt quench step discussed earlier as part of the present invention can produce higher fracture toughness values than simple air cooling process. In terms of creep life, Ti-6242 given a conventional process and tested at 800° F./65 KSI will undergo 0.1% creep in about 55 hours whereas Ti-6246 processed according to the present invention will require about 120hours to undergo the same amount of creep.

In fatigue testing, conventionally processed Ti-6242 failed after from $1\times10^4$ to $4\times10^4$ cycles while material processed according to the present invention showed no signs of failure at $3\times10^5$ cycles.

Thus, the invention process provides a method that improves certain mechanical properties of Ti-6246 without unduly reducing other important properties. Ti-6246 processed according to the invention will display properties which are generally better than those of Ti-6242.

Although this invention has been shown and described with respect to detailed embodiments thereof, it will be understood by those skilled in the art that various changes in form and detail thereof may be made without departing from the spirit and scope of the claimed invention.

TABLE II

AIR COOLED
(Parenthetical Values are for Prior Art)
Tensile Properties

| Test Temp, °F. | 0.2% YS KSI | UTS KSI | % El |
|---|---|---|---|
| RT | 145.1 (155) | 167.3 (170) | 9.5 (16) |
| 600 | 105.1 (NA) | 135.0 (NA) | 10.5 (NA) |
| 800 | 102.3 (100) | 135.5 (125) | 13.5 (18) |
| 900 | 96.7 (NA) | 128.3 (NA) | 16.0 (NA) |

Creep at 800° F./65 KSI, Hours to 0.1% Elongation = 120 (129)
Room Temperature Fracture Toughness
$K_1C$, KSI $in^{\frac{1}{2}}$ = 60 (29–37)

TABLE III

SALT QUENCHED
(Parenthetical Values are for Prior Art)
Tensile Properties

| Test Temp, °F. | Salt Quench Temp, °F. | 0.2% YS, KSI | UTS, KSI | % El |
|---|---|---|---|---|
| RT | 1400 | 141.6 (155) | 162.8 (170) | 13.0 (16) |
| 600 | 1400 | 101.2 (NA) | 132.9 (NA) | 14.8 (NA) |
| RT | 1300 | 136.2 (155) | 156.2 (170) | 14.2 (16) |
| 600 | 1300 | 98.9 (NA) | 125.7 (NA) | 16.3 (NA) |

Room Temperature Fracture Toughness

| Salt Quench Temp, °F. | $K_1C$, KSI in$^{\frac{1}{2}}$ |
|---|---|
| 1400 | 65.5 (29-37) |
| 1300 | 70.6 (29-37) |

TABLE IV

WATER QUENCH & REHEAT
(Parenthetical Values are for Prior Art)
Tensile Properties

| Test Temp, °F. | Reheat Temp, °F. | 0.2% YS, KSI | UTS, KSI | % El |
|---|---|---|---|---|
| RT | 1500 | 145 (155) | 164 (170) | 10.0 (16) |
| RT | 1600 | 145 (155) | 162 (170) | 10.0 (16) |
| RT | 1650 | 146 (155) | 163 (170) | 11.0 (16) |

Room Temperature Fracture Toughness

| Reheat Temp, °F. | $K_1C$, KSI in 0.5 |
|---|---|
| 1500 | 66 (29-37) |
| 1600 | 71 (29-37) |
| 1650 | 72 (29-37) |

Creep at 800° F./65 KSI, hours to 0.1% elongation

| Reheat Temp, °F. | |
|---|---|
| 1500 | 360 (120) |
| 1600 | 200 (120) |
| 1660 | 370 (120) |

We claim:

1. Method for heat treating Ti-6246 alloy having a beta transus of about 1730° F. to improve LCF and toughness including the steps of:

a. hot die forging the alloy above the beta transus;

b. solution treating the forged alloy below but within about 50° F. of the beta transus;

c. salt quenching the forged alloy in a bath held at 400°-1400° F., and d. precipitation treating the forged alloy at 1100°-1200° F. for 2-16 hours.

2. Method as in claim 1 wherein the forging comprises at least a 2:1 reduction in area.

3. Method as in claim 1 wherein the forging is performed at a temperature above but within about 100° F. of the beta transus.

4. Method as in claim 1 wherein the time of the solution treatment is from about 1 to 4 hours.

5. Method as in claim 1 wherein the time of the precipitation treatment is from 2 to 16 hours.

6. Method for heat treating Ti-6246 alloy having a beta transus of about 1730° F. to improve LCF and toughness including the steps of:

a. hot die forging the alloy above the beta transus;

b. solution treating the forged alloy below but within about 50° F. of the beta transus;

c. water quenching the forged alloy;

d. heating the forged alloy at a temperature between about 1500° F. and the solution treatment temperature of step b. 1-10 hours, and e. precipitation treating the forged alloy at 1100°-1200° F. for 2-16 hours.

7. Method as in claim 6 wherein the forging comprises at least a 2:1 reduction in area.

8. Method as in claim 6 wherein the forging is performed at a temperature above but within about 100° F. of the beta transus.

9. Method as in claim 6 wherein the time of the solution treatment is from about 1 to 4 hours.

10. Method as in claim 6 wherein the time of the precipitation treatment is from 2 to 16 hours.

* * * * *